US008336984B2

(12) United States Patent
Rzadca et al.

(10) Patent No.: US 8,336,984 B2
(45) Date of Patent: Dec. 25, 2012

(54) ENCODER FOR INKJET PRINTERS

(75) Inventors: Mark C. Rzadca, Fairport, NY (US); Thomas D. Pawlik, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 207 days.

(21) Appl. No.: 12/871,068

(22) Filed: Aug. 30, 2010

(65) Prior Publication Data

US 2012/0050371 A1 Mar. 1, 2012

(51) Int. Cl.
*B41J 29/38* (2006.01)

(52) U.S. Cl. ..... 347/16

(58) Field of Classification Search ..... 347/16, 347/101, 104

See application file for complete search history.

(56) References Cited

U.S. PATENT DOCUMENTS

| | | | |
|---|---|---|---|
| 3,949,856 | A | 4/1976 | Ulber et al. |
| 4,892,426 | A | 1/1990 | Steele |

FOREIGN PATENT DOCUMENTS

| | | |
|---|---|---|
| DE | 90 07 377 | 4/1991 |
| EP | 0 350 050 | 1/1990 |
| JP | 60 137757 | 7/1985 |
| JP | 2007 084271 | 4/2002 |

*Primary Examiner* — An Do

(74) *Attorney, Agent, or Firm* — Peyton C. Watkins

(57) ABSTRACT

An inkjet printer includes a paper tray for holding print media; a pick roller for moving the print media through a paper transport path; and an encoder disk, which senses motion of the print media, disposed in the paper transport path and in direct contact with the print media as the print media passes through the paper transport path.

17 Claims, 12 Drawing Sheets

MEDIA IDENTIFICATION READER
604
NO SLIPPAGE
604
SLIPPAGE
604
TIME
605
606

MEDIA MOTION ENCODER
608
609
TIME

DRIVE TRAIN ENCODER (PRIOR ART)
611
612
TIME

ENCODER FOR INKJET PRINTERS

CROSS REFERENCE TO RELATED APPLICATIONS

Reference is made to commonly assigned U.S. patent application Ser. No. 12/887,532 filed Sep. 22, 2010 by Thomas D. Pawlik et al., entitled "Optical Sensor for Printer Media Motion Detection," the disclosure of which is herein incorporated by reference.

FIELD OF THE INVENTION

The present invention generally relates to encoders of inkjet printers. In particular, the present invention relates to encoders positioned in direct contact with the print media whose motion it's sensing for improved accuracy in reading the motion of the print media.

BACKGROUND OF THE INVENTION

An inkjet printing system typically includes one or more printheads and their corresponding ink supplies. Each printhead includes an ink inlet that is connected to its ink supply and an array of drop ejectors, each ejector consisting of an ink pressurization chamber, an ejecting actuator and a nozzle through which droplets of ink are ejected. The ejecting actuator may be one of various types, including a heater that vaporizes some of the ink in the pressurization chamber in order to propel a droplet out of the orifice, or a piezoelectric device which changes the wall geometry of the chamber in order to generate a pressure wave that ejects a droplet. The droplets are typically directed toward paper or other recording medium in order to produce an image according to image data that is converted into electronic firing pulses for the drop ejectors as the recording medium is moved relative to the printhead.

A common type of printer architecture is the carriage printer, where the printhead nozzle array is somewhat smaller than the extent of the region of interest for printing on the recording medium and the printhead is mounted on a carriage. In a carriage printer, the recording medium is advanced a given distance along a media advance direction and then stopped. While the recording medium is stopped, the printhead carriage is moved in a direction that is substantially perpendicular to the media advance direction as the drops are ejected from the nozzles. After the carriage has printed a swath of the image while traversing the recording medium, the recording medium is advanced; the carriage direction of motion is reversed, and the image is formed swath by swath.

The ink supply on a carriage printer can be mounted on the carriage or off the carriage. For the case of ink supplies being mounted on the carriage, the ink tank can be permanently integrated with the printhead as a print cartridge, so that the printhead needs to be replaced when the ink is depleted, or the ink tank can be detachably mounted to the printhead so that only the ink tank itself needs to be replaced when the ink tank is depleted. Carriage mounted ink supplies typically contain only enough ink for up to about several hundred prints. This is because the total mass of the carriage needs be limited so that accelerations of the carriage at each end of the travel do not result in large forces that can shake the printer back and forth.

Pickup rollers are used to advance the print media from its holding tray along a transport path towards a print zone beneath the carriage printer where the ink is projected onto the print media. The pickup roller is part of a complex gear train in which the pickup roller initiates print movement and a drive system encoder is disposed on the gear train (or coaxially of the pickup roller) for reading the amount of motion. It is instructive to note that, in the prior art, the encoder is not in direct contact with the print media. Furthermore, lacking a means of directly sensing movement of the media, any slippage of the media with respect to the drive system is not apparent via the encoder of the prior art. Some printers include a barcode reader adjacent to the pickup roller for reading a barcode, described below, on the print media as it passes beneath the barcode reader.

In regards to the barcode, the print media may include barcodes on its non-printing side for identifying the type of print media so that printing adjustments can be made depending on the type of print media. The barcode includes a plurality of parallel lines in a predetermined spaced-apart relationship. The width of the spacing varies according to the type of print media so that each type of print media has its own unique barcode. Any slippage of the print media as it is being read by the barcode reader can cause the type of print media to be misidentified.

Although the presently used system is satisfactory, improvements are always desirable. One such improvement is improved accuracy of the print media motion so that accurate readings of the barcode are obtained.

SUMMARY OF THE INVENTION

The present invention is directed to overcoming one or more of the problems set forth above. Briefly summarized, according to one aspect of the invention, the invention resides in an inkjet printer having a paper tray for holding print media; a pick roller for moving the print media through a paper transport path; and an encoder disk, which senses motion of the print media, disposed in the paper transport path and in direct contact with the print media as the print media passes through the paper transport path.

These and other objects, features, and advantages of the present invention will become apparent to those skilled in the art upon a reading of the following detailed description when taken in conjunction with the drawings wherein there is shown and described an illustrative embodiment of the invention.

ADVANTAGEOUS EFFECT OF THE INVENTION

The present invention has the advantage of greater accuracy in reading spatial patterns on print media so that a more precise indicator of incremental motion is obtained. This, in turn, provides for more precise interpretation of the spatial encoding of the decoded information from the spatial patterns.

Direct sensing provides greater accuracy (compared with the prior art drive system encoder) in terms of delivering the leading edge to a predetermined position. In addition, a direct sensing encoder, in combination with the prior art drive system encoder, provides an ability to quickly detect when a paper miss-feed has occurred. If the paper should stall after motion begins, or if motion does not begin when anticipated, the lack of motion can be quickly discerned by the lack of signal from the contact encoder.

BRIEF DESCRIPTION OF THE DRAWINGS

While the specification concludes with claims particularly pointing out and distinctly claiming the subject matter of the present invention, it is believed that the invention will be better understood from the following description when taken in conjunction with the accompanying drawings, wherein:

DETAILED DESCRIPTION OF THE INVENTION

Figure 1:
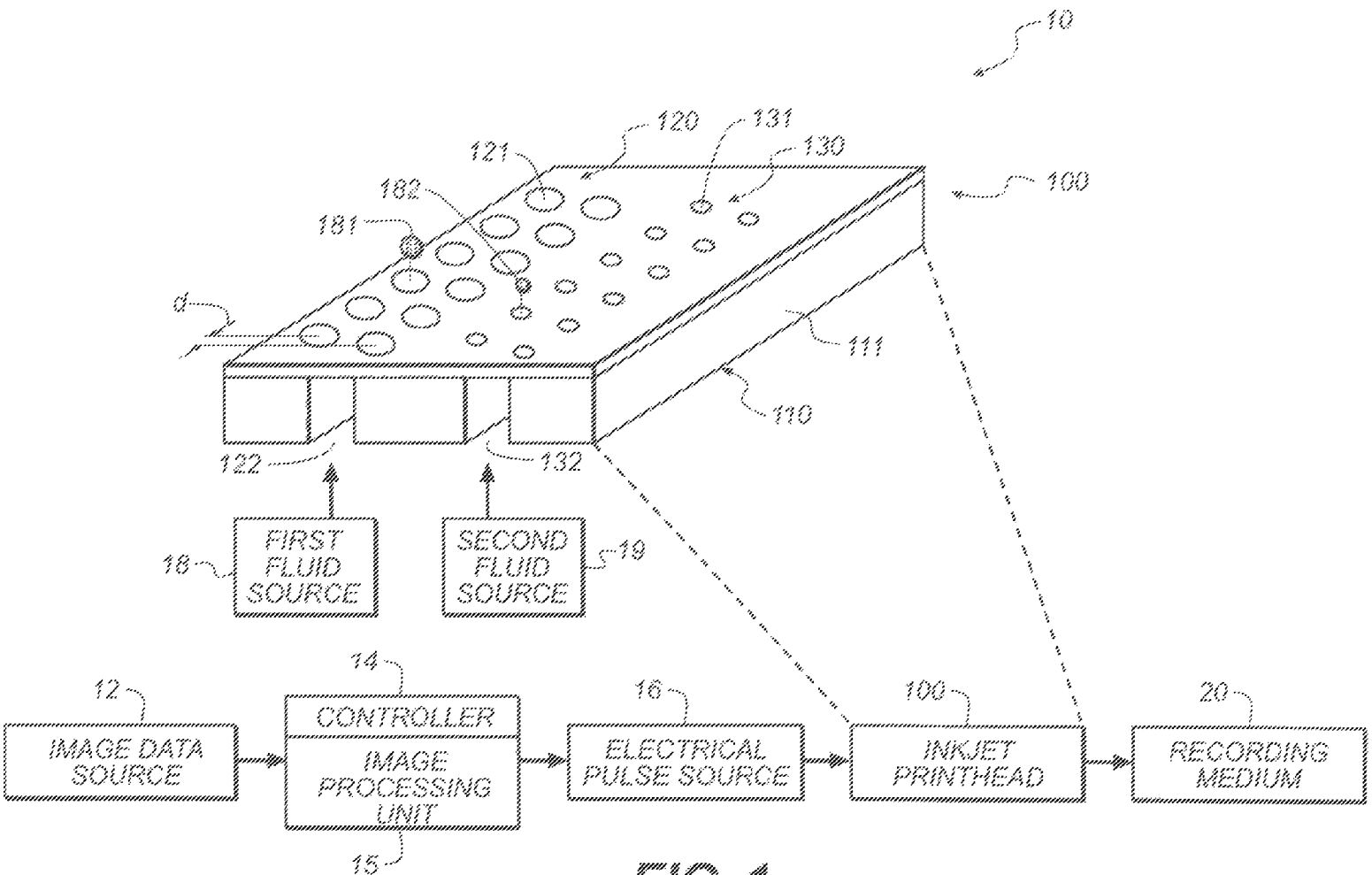
FIG. 1 is a schematic representation of an inkjet printer system.

Referring to FIG. 1, a schematic representation of an inkjet printer system 10 is shown for its usefulness with the present invention and is fully described in U.S. Pat. No. 7,350,902, which is incorporated by reference herein in its entirety. Inkjet printer system 10 includes an image data source 12, which provides data signals that are interpreted by a controller 14 as being commands to eject drops. Controller 14 includes an image processing unit 15 for rendering images for printing, and the controller 14 outputs signals to an electrical pulse source 16 of electrical energy pulses that are inputted to an inkjet printhead 100, which includes at least one inkjet printhead die 110.

In the example shown in FIG. 1, there are two nozzle arrays. Nozzles 121 in the first nozzle array 120 have a larger opening area than nozzles 131 in the second nozzle array 130. In this example, each of the two nozzle arrays has two staggered rows of nozzles, each row having a nozzle density of 600 per inch. The effective nozzle density then in each array is 1200 per inch (i.e. d=1/1200 inch in FIG. 1). If pixels on the recording medium 20 were sequentially numbered along the paper advance direction, the nozzles from one row of an array would print the odd numbered pixels, and the nozzles from the other row of the array would print the even numbered pixels.

In fluid communication with each nozzle array is a corresponding ink delivery pathway. Ink delivery pathway 122 is in fluid communication with the first nozzle array 120, and ink delivery pathway 132 is in fluid communication with the second nozzle array 130. Portions of ink delivery pathways 122 and 132 are shown in FIG. 1 as openings through printhead die substrate 111. One or more inkjet printhead die 110 will be included in inkjet printhead 100, but for greater clarity only one inkjet printhead die 110 is shown in FIG. 1. The printhead die are arranged on a support member as discussed below relative to FIG. 2. In FIG. 1, first ink source 18 supplies ink to first nozzle array 120 via ink delivery pathway 122, and second ink source 19 supplies ink to second nozzle array 130 via ink delivery pathway 132. Although distinct ink sources 18 and 19 are shown, in some applications it may be beneficial to have a single ink source supplying ink to both the first nozzle array 120 and the second nozzle array 130 via ink delivery pathways 122 and 132 respectively. Also, in some embodiments, fewer than two or more than two nozzle arrays can be included on printhead die 110. In some embodiments, all nozzles on inkjet printhead die 110 can be the same size, rather than having multiple sized nozzles on inkjet printhead die 110.

The drop forming mechanisms associated with the nozzles are not shown in FIG. 1. Drop forming mechanisms can be of a variety of types, some of which include a heating element to vaporize a portion of ink and thereby cause ejection of a droplet, or a piezoelectric transducer to constrict the volume of a fluid chamber and thereby cause ejection, or an actuator which is made to move (for example, by heating a bi-layer element) and thereby cause ejection. In any case, electrical pulses from electrical pulse source 16 are sent to the various drop ejectors according to the desired deposition pattern. In the example of FIG. 1, droplets 181 ejected from the first nozzle array 120 are larger than droplets 182 ejected from the second nozzle array 130, due to the larger nozzle opening area. Typically other aspects of the drop forming mechanisms (not shown) associated respectively with nozzle arrays 120 and 130 are also sized differently in order to optimize the drop ejection process for the different sized drops. During operation, droplets of ink are deposited on a recording medium 20.

Figure 2:
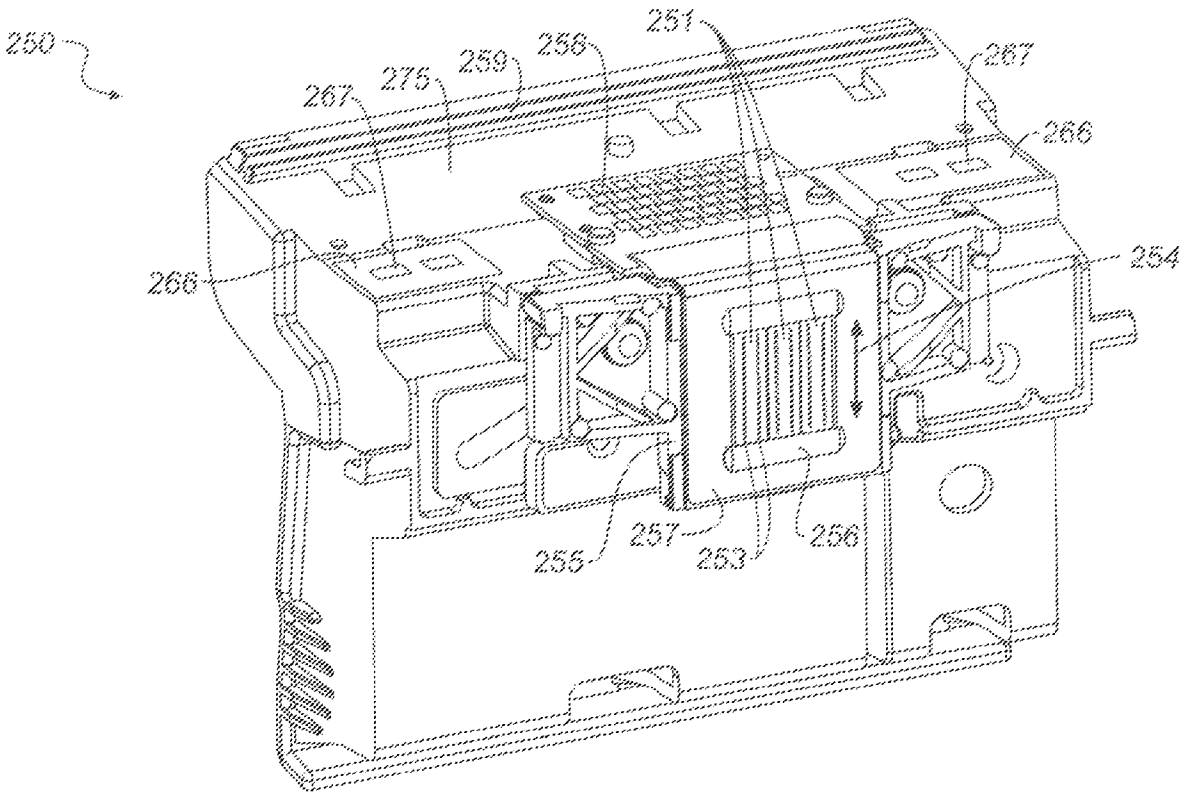
FIG. 2 is a perspective view of a portion of a printhead.

FIG. 2 shows a perspective view of a portion of a print cartridge 250, which is an example of an inkjet printhead 100 plus ink sources 18 and 19. Print cartridge 250 includes two printhead die 251 (similar to printhead die 110 in FIG. 1) that are affixed to mounting substrate 255. Each printhead die 251 contains two nozzle arrays 253 so that print cartridge 250 contains four nozzle arrays 253 altogether. The four nozzle arrays 253 in this example are each connected to ink sources (not shown in FIG. 2), such as cyan, magenta, yellow, and black. Each of the four nozzle arrays 253 is disposed along nozzle array direction 254, and the length of each nozzle array along the nozzle array direction 254 is typically on the order of 1 inch or less. Typical lengths of recording media are 6 inches for photographic prints (4 inches by 6 inches) or 11 inches for paper (8.5 by 11 inches). Thus, in order to print a full image, a number of swaths are successively printed while moving print cartridge 250 across the recording medium 20. Following the printing of a swath, the recording medium 20 is advanced along a media advance direction that is substantially parallel to nozzle array direction 254.

Also shown in FIG. 2 is a flex circuit 257 to which the printhead die 251 are electrically interconnected, for example, by wire bonding or TAB bonding. The interconnections are covered by an encapsulant 256 to protect them. Flex circuit 257 bends around the side of print cartridge 250 and connects to connector board 258 on rear wall 275. A lip 259 on rear wall 275 serves as a catch for latching print cartridge 250 into the carriage 200. When print cartridge 250 is mounted into the carriage 200 (see FIGS. 3), connector board 258 is electrically connected to a connector on the carriage 200 so that electrical signals can be transmitted to the printhead die 251. Print cartridge 250 also includes two devices 266 mounted on rear wall 275. When print cartridge 250 is properly installed into the carriage of a carriage printer, electrical contacts 267 will make contact with an electrical connector on the carriage.

Figure 3:
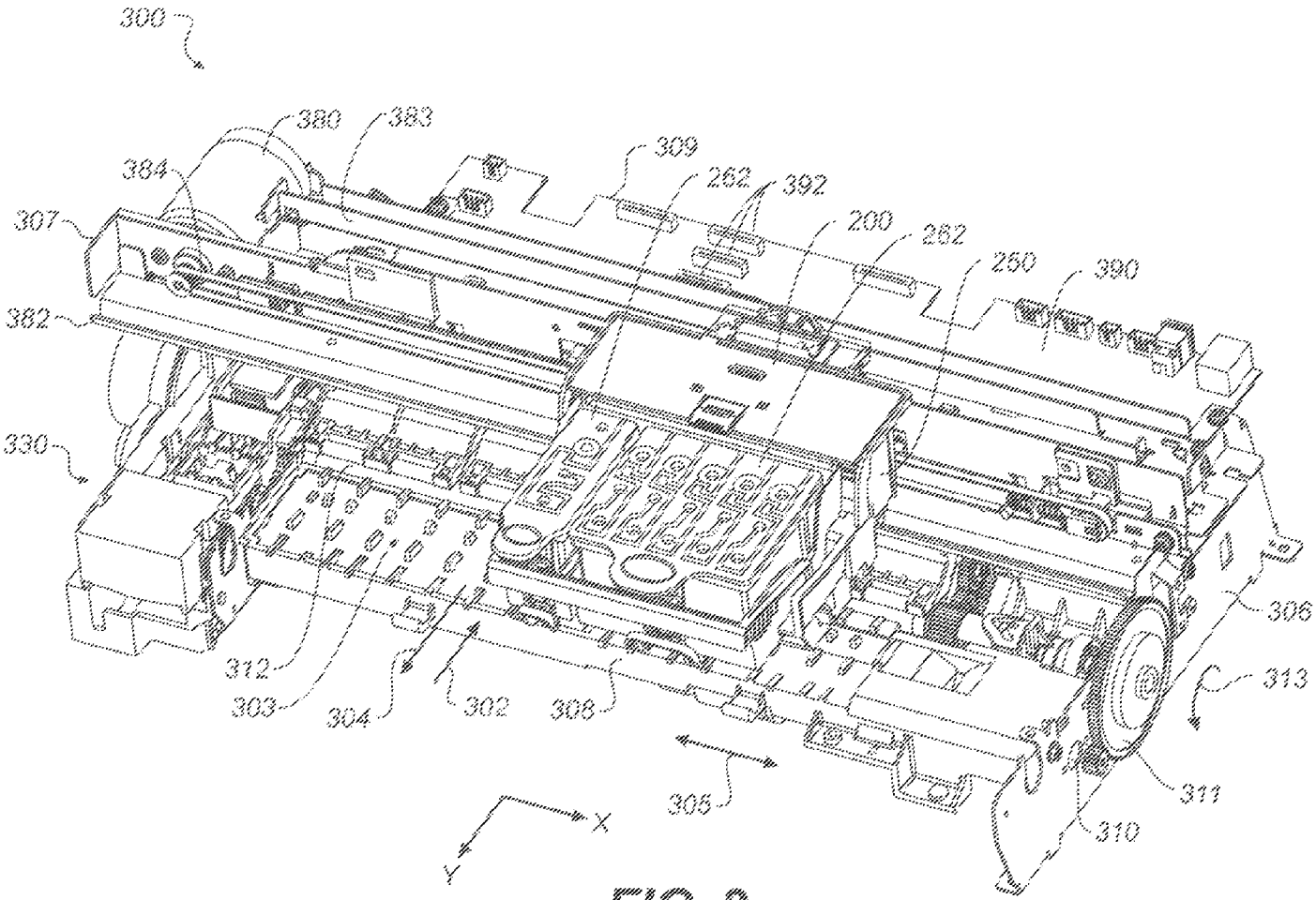
FIG. 3 is a perspective view of a portion of a carriage printer.

FIG. 3 shows a portion of a desktop carriage printer. Some of the parts of the printer have been hidden in the view shown in FIG. 3 so that other parts can be more clearly seen. Printer chassis 300 has a print region 303 across which carriage 200 is moved back and forth in carriage scan direction 305 between the right side 306 and the left side 307 of printer chassis 300, while drops are ejected from printhead die 251 (not shown in FIG. 3) on print cartridge 250 that is mounted on carriage 200. Carriage motor 380 moves belt 384 to move carriage 200 along carriage guide rail 382.

The mounting orientation of print cartridge 250 is rotated relative to the view in FIG. 2, so that the printhead die 251 are located at the bottom side of print cartridge 250, the droplets of ink being ejected downward onto the recording medium in print region 303 in the view of FIG. 3. Cyan, magenta, yellow and black ink sources 262 are integrated into print cartridge 250. Paper or other recording medium (sometimes generically referred to as paper or media herein) is loaded along paper load entry direction 302 toward the front of printer chassis 308.

Figure 4:
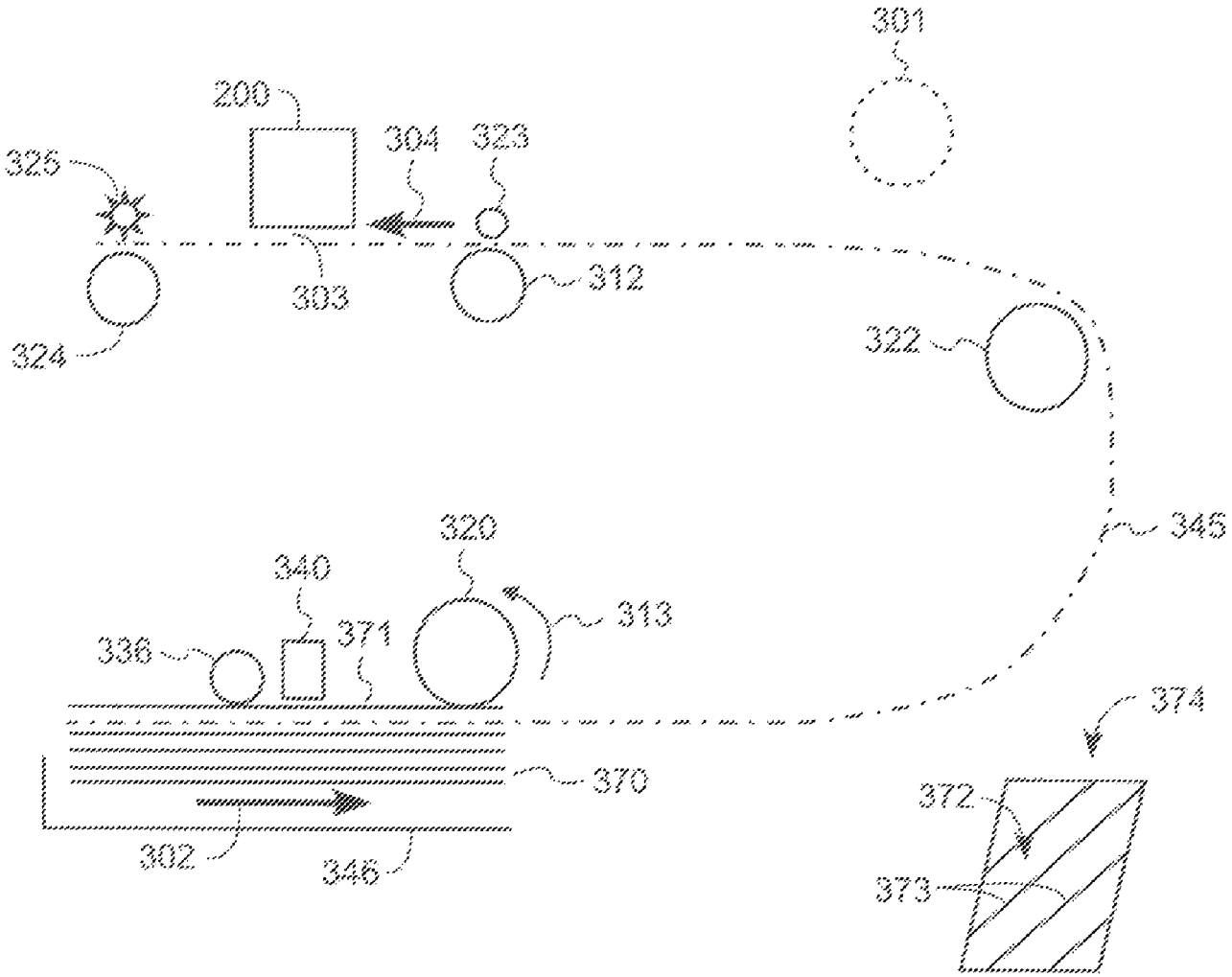
FIG. 4 is a schematic side view of a paper path in a carriage printer of the present invention.

A variety of rollers are used to advance the medium through the paper transport path 345 (indicated by the dot dash lines) of the printer as shown schematically in the side view of FIG. 4. The paper transport path 345 is defined as the path the paper takes from its initial position in the media stack 370 to its printing position in the print region 303. In this example, a pick-up roller 320 moves the top piece or sheet 371 of a stack 370 of paper or other recording medium in the direction of arrow, paper load entry direction 302. A turn roller 322 acts to move the paper around a C-shaped path (in cooperation with a curved rear wall surface) so that the paper continues to advance along media advance direction 304 from the rear 309 of the printer chassis (with reference also to FIG. 3). The paper is then moved by feed roller 312 and idler roller(s) 323 to advance across print region 303, and from there to a discharge roller 324 and star wheel(s) 325 so that printed paper exits along media advance direction 304. Feed roller 312 includes a feed roller shaft along its axis, and feed roller gear 311 (see FIG. 3) is mounted on the feed roller shaft. Feed roller 312 can include a separate roller mounted on the feed roller shaft, or can include a thin high friction coating on the feed roller shaft The motor that powers the paper advance rollers is not shown in FIG. 3, but the hole 310 at the printer chassis right-side 306 is where the motor gear (not shown) protrudes through in order to engage feed roller gear 311, as well as the gear for the discharge roller (not shown). For normal paper pick-up and feeding, it is desired that all rollers rotate in forward rotation direction 313. Toward the printer chassis left-side 307, in the example of FIG. 3, is the maintenance station 330.

Toward the printer chassis rear 309, in this example, there is located the electronics board 390, which includes cable connectors 392 for communicating via cables (not shown) to the printhead carriage 200 and from there to the print cartridge 250. Also on the electronics board are typically mounted motor controllers for the carriage motor 380 and for the paper advance motor, a processor and/or other control electronics (shown schematically as controller 14 and image processing unit 15 in FIG. 1) for controlling the printing process, and an optional connector for a cable to a host computer.

Figure 10:
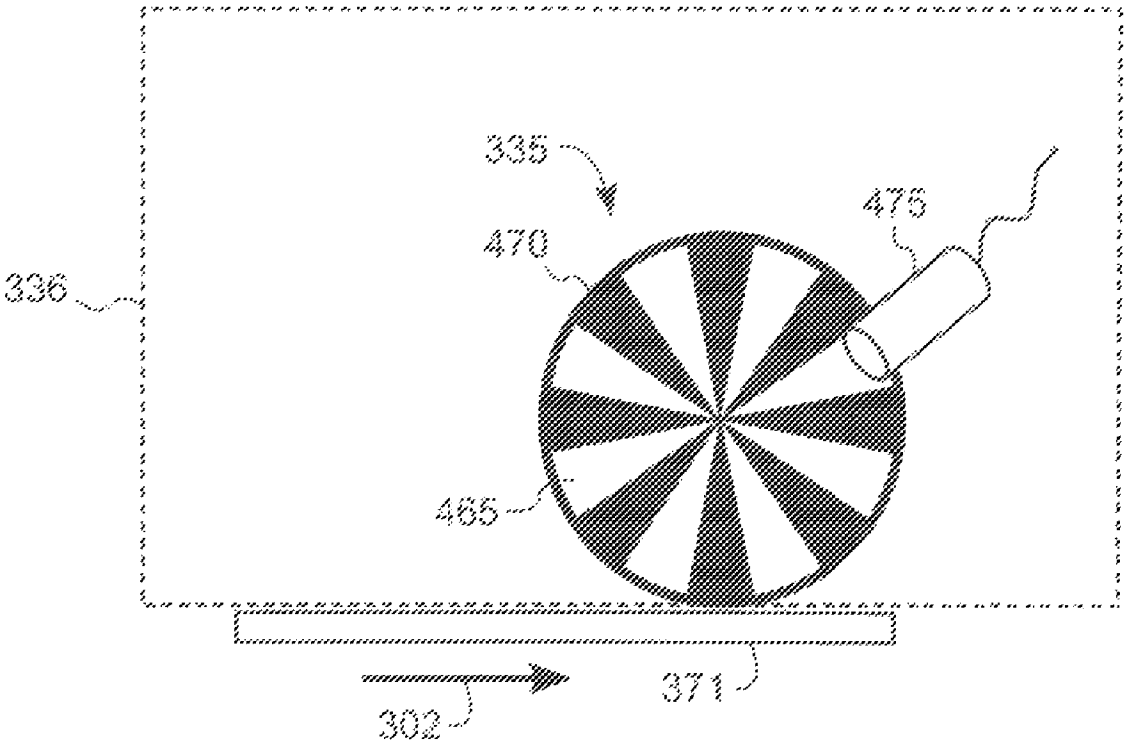
FIG. 10 is an alternative embodiment of the encoder of the present invention.
Figure 11:
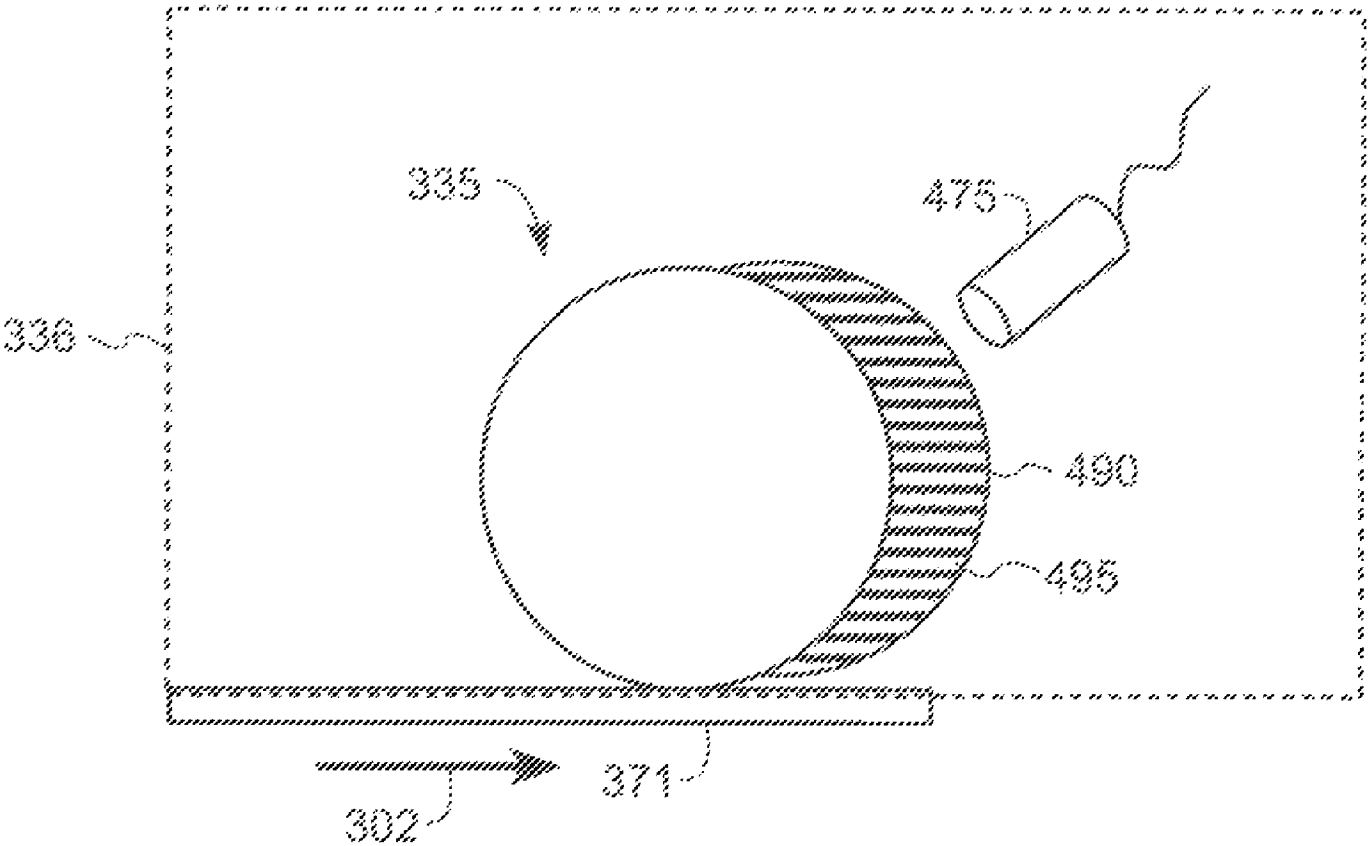
FIG. 11 is an alternative embodiment of the encoder of the present invention.

Referring to FIG. 4, a media motion encoder 336 senses the motion of media 371 and directly contacts the media 371. This direct contact provides greater accuracy of the motion of the media 371 as compared to prior art in which drive system encoders are placed along the gear train of the pickup roller and are not in contact with the media 371. The media motion encoder 336 includes an encoder 335 (see FIGS. 6-11) and its associated components necessary to generate a signal representative of the encoder data. In FIGS. 6 through 9, the additional components are a light source and a light receiver. In FIGS. 10 and 11, the additional components are magnetic regions or poles and a magnetic field sensor. All of these components will be discussed in detail hereinbelow. It is further noted that the encoder 335 is preferably in the form of a disk, although other forms are also usable such as a drum and the like. In addition, the light from the light source may not only be in the visible wavelengths but in the invisible wavelengths.

An identification mark reader 340, preferably a barcode sensor, reads media identification markings 372, preferably a barcode, on the non-print side 374 of the media 371 for determining the type of media being used. The barcode 372 includes a plurality of parallel lines 373 in a predetermined spaced-apart relationship so that each type of print media 371 has its own unique barcode 372. Since the media motion encoder 335 is in direct contact with the media 371, there is improved measurement accuracy of the motion of the media 371 and reading of the barcode 372.

Ideally, the encoder 335 (i.e., position encoder) is located at the same position, in the direction of media travel, as the barcode sensor 340. In the direction perpendicular to media travel, the encoder 335 should be located as close as possible to the barcode sensor 340. This ensures that during the paper feed valid information from the media motion encoder 336 and valid information from the barcode sensor 340 are available concurrently. The displacement perpendicular to media travel direction should be small enough to permit sensing motion of the smallest dimension paper for which the printer was intended. Frequently this minimum dimension is 4 inches. Depending on additional functionalities of the media motion encoder 336, such as the detection of paper mis-feeds, the optimum position can be further away from the barcode sensor 340.

Although the encoder 335 is illustrated having preferred positions, the encoder 335 may be placed anywhere suitable along the paper transport path 345, which is the path the media 371 takes for printing starting from its initial position in a paper tray 346 all the way to the print zone 303.

Figures 5A, 5B, 5C:
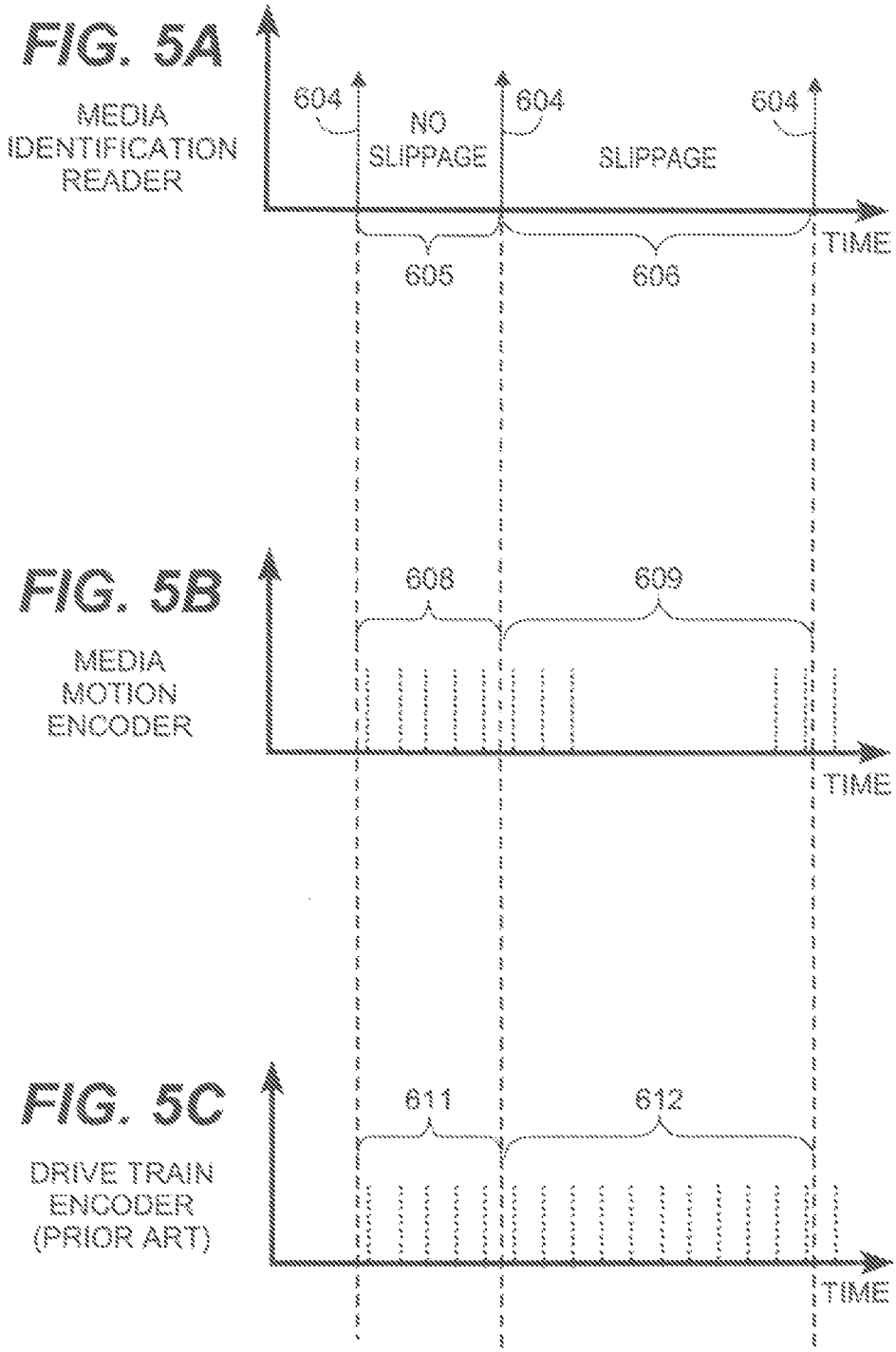
FIG. 5 is a schematic representation of comparative performance of the present invention and the prior art in the presence of media slip.
Figure 5D:
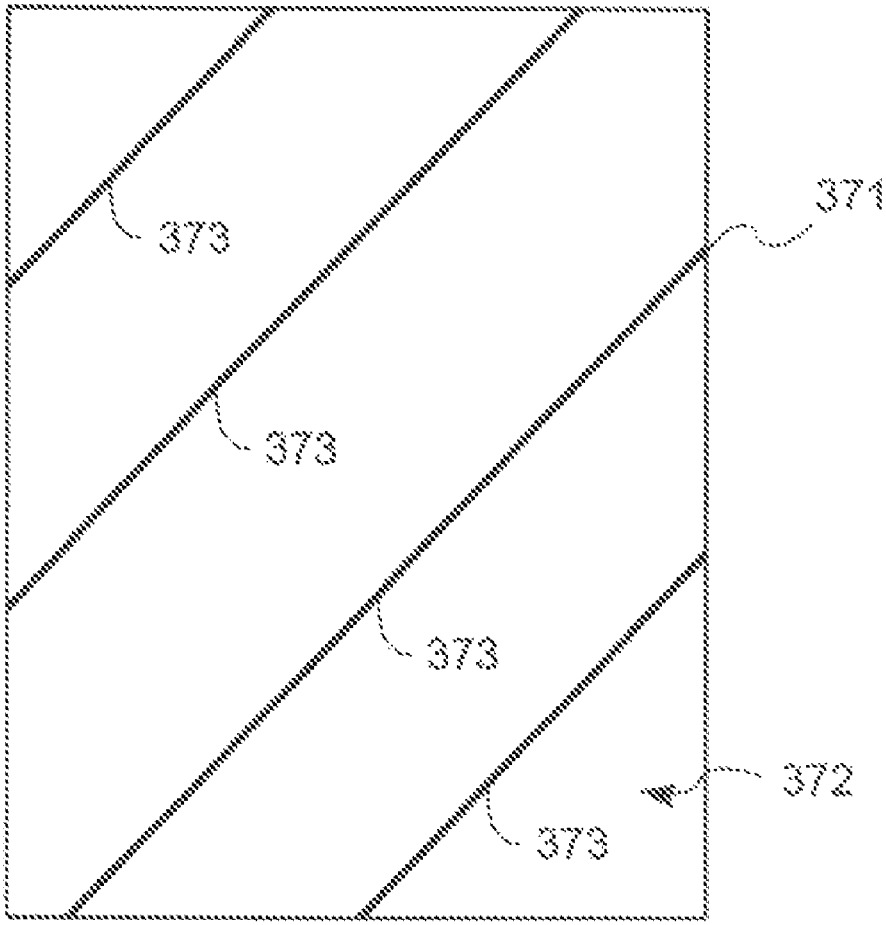

In FIG. 5D, the non printing side 374 of sheet of media 371 is illustrated having evenly spaced media identification marks 372. Media identification marks 372 are detected by the identification mark detector 340, such as the barcode sensor, the output of which is shown in 5A. The presence of the media identification marks 372 is represented as signal lines 604. The physical or spatial distance between media identification marks 372 is indicated by the number of encoder pulses (dotted line of FIGS. 5B and 5C) occurring between media identification marks. For example, when there is no media slippage, the time between signals 604 is represented as elapsed time 605, and when there is media slippage, the time between signals 604 is representative as elapsed time 606.

In the prior art drive system encoder 301 described above in the Background (FIG. 5C and 301 in FIG. 4), the number of signal counts 611 (representative of no media slippage) and the number of signal counts 612 (representative of media slippage) from the drive train encoder indicate relative incremental motion of the drive train. Drive train encoder pulses correctly indicate the distance in terms of encoder counts (611) when the media does not slip. In the case where the media slips with respect to the drive train encoder, a greater number of encoder counts occur (612) incorrectly indicating a greater separation between adjacent media marks.

FIG. 5B illustrates encoder count signals (represented as dotted lines) from the media motion encoder 336 of the present invention. The number of signals (608 and 609) from the media motion encoder 336 indicates relative incremental motion of the media 371. With the present invention, the signals 608 from media motion encoder 336 provide an accurate indication of the motion of the media 372 when slippage is not present as well as providing accurate signals 609 when slippage is present since the media motion encoder 336 represents media motion, not drive train motion.

It is noted that, optionally, the prior art drive system encoder 301 (see FIG. 4) may be used in combination with the media motion encoder 336 of the present invention for providing an ability to quickly detect when a paper miss-feed has occurred. If the paper should stall after motion begins, or if motion does not begin when anticipated, the lack of motion can be quickly discerned by the lack of signal from the media motion encoder 336.

Figure 6:
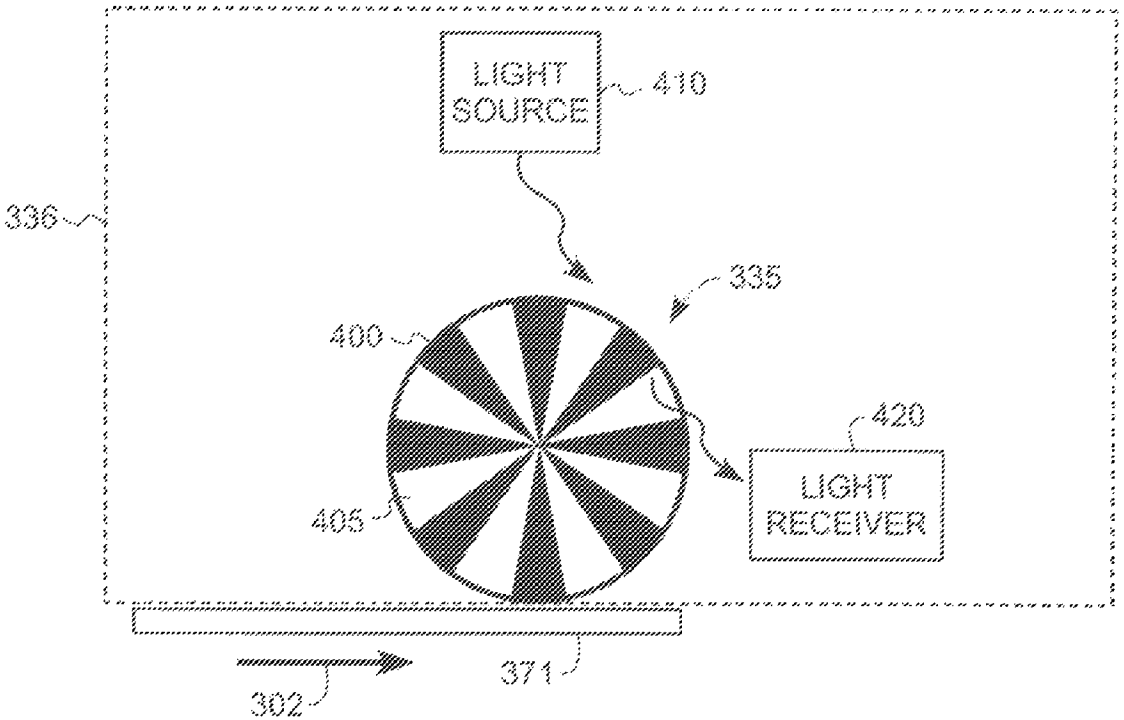
FIG. 6 is an embodiment of the encoder of the present invention.

The particular configuration of the media motion encoder 336 varies according to the particular need of the printer. FIG. 6 illustrates one of the many embodiments of the present invention that the media motion encoder 336 may take. In this embodiment, the media motion encoder 336 includes the encoder 335 that includes one or more opaque spokes 400 and one or more open areas 405. When there are a plurality of spokes 400 and open areas 405, the spokes 400 are in a spaced-apart relationship with each other and adjacent to an open area 405 forming an alternating pattern so that light passes through the open areas 405. In the simplest implementation, the encoder 335 includes a single open area 405 and a single spoke 400. The perimeter of the encoder 335 is preferably coated with a high friction material thus ensuring good mechanical coupling between the media surface and the encoder circumferential surface. The encoder 335 is mounted such that mechanical contact of the perimeter with the non-print side of media 374 is amenable to any height of the media stack 370. Suitable embodiments for mounting the encoder 335 include a pivoting arm (not shown) which exerts downward pressure on the encoder wheel through gravity and/or spring loading. As the encoder 335 rotates following the paper (media) advance motion, a light source 410 (preferably LED light source) transmits light toward the encoder 335. The spokes 400 block the light from passing to the other side of the encoder 335, and the open areas 405 permit light to pass to the other side of the encoder 335 where a light receiver 420 receives the light which is converted to an electronic signal indicating motion of the media 371. The light receiver may include a phototransistor or other light sensing components.

Figure 7:
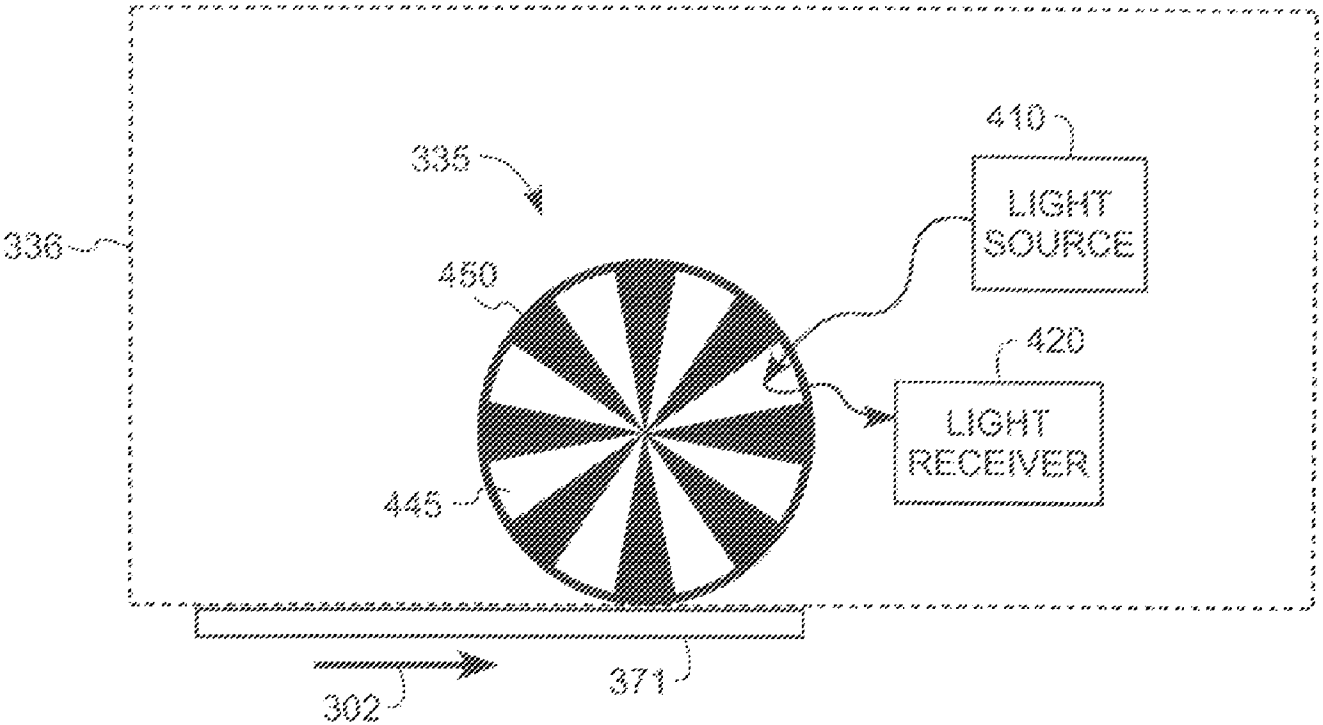
FIG. 7 is an alternative embodiment of the encoder of the present invention.

Referring to FIG. 7, there is shown another embodiment of the media motion encoder 336 of the present invention. The media motion encoder 336 includes an encoder 335 having one or more reflective portions 445 and one or more non-reflective portions 450. When there are a plurality of reflective portions 445 and non-reflective portions 450, the reflective portions 445 are in a spaced-apart relationship with each other and adjacent to a non-reflective area 450 forming an alternating pattern. In the simplest implementation, the encoder 335 includes a single reflective portion single 445 and a single non-reflective portion 450. The reflective portions 445 may be any suitable material such as patches of white colorant or metalized patches with a mirror finish, and the non-reflective portions 450 may be suitable materials such as patches of black colorant. In this embodiment, the light source 410 and light receiver 420 are on the same side of the encoder 335 since the light receiver 420 senses reflected light.

Figure 8:
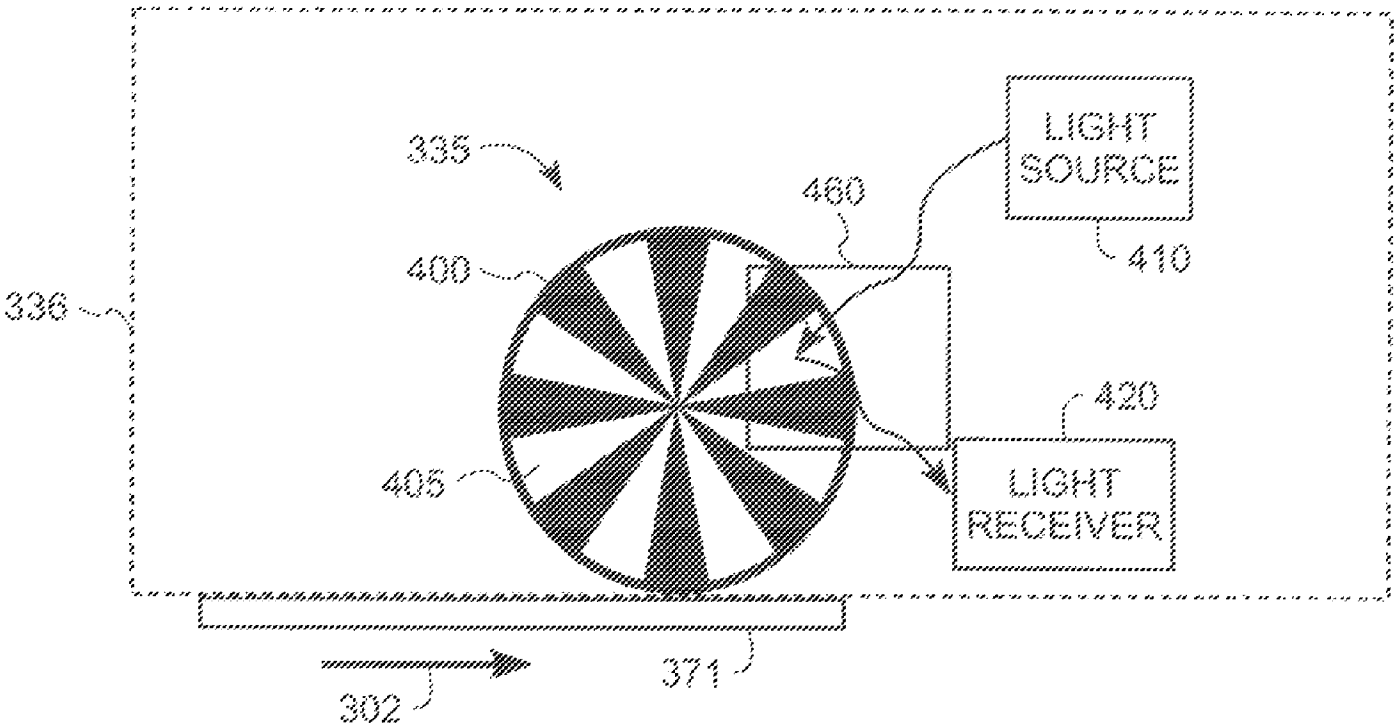
FIG. 8 is an alternative embodiment of the encoder of the present invention.

Referring to FIG. 8, there is shown still a third embodiment of the media motion encoder 336 of the present invention. In this embodiment, the media motion encoder 336 includes the encoder 335 having one or more opaque spokes 400 and one or more open areas 405. When there are a plurality of spokes 400 and open areas 405, the spokes 400 are in a spaced-apart relationship with each other and adjacent to an open area 405 forming an alternating pattern so that light passes through the open areas 405. In the simplest implementation, the encoder 335 includes a single open area 405 and a single spoke 400. As the encoder 335 rotates, a reflective surface 460, which is disposed on a side of the encoder 335 opposite from the side of the light receiver 420, reflects the light back through the open areas 405 to the light receiver 420.

Figure 9:
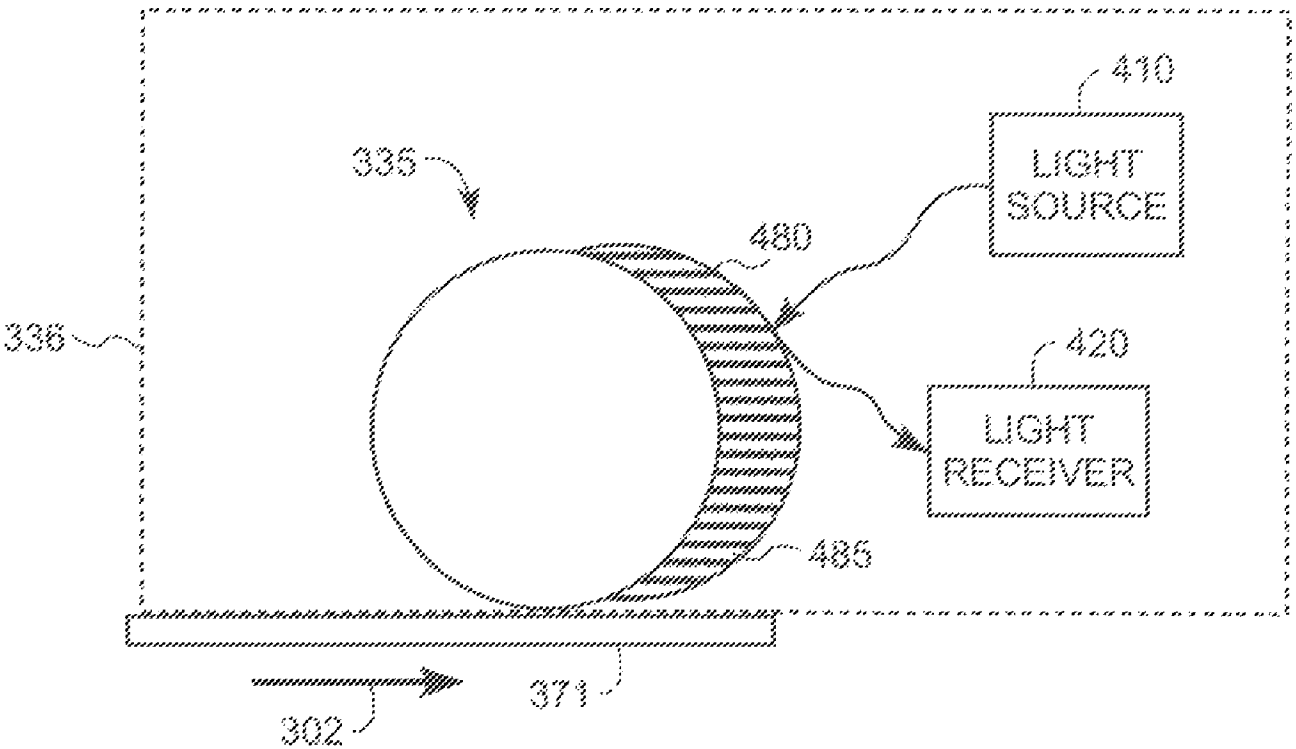
FIG. 9 is an alternative embodiment of the encoder of the present invention.

Referring to FIG. 9, there is shown a fourth embodiment of the media motion encoder 336 of the present invention. The media motion encoder 336 includes the encoder 335 having one or more reflective portions 485 disposed along the circumferential portion of the encoder 335 and one or more non-reflective portions 480 disposed along the circumferential portion. When there are a plurality of both reflective portions 485 and non-reflective portions 480, the reflective portions 485 are in a spaced-apart relationship with each other and adjacent to a non-reflective portion 480 forming an alternating pattern. Each reflective portion 485 and non-reflective portion 480 is arcuate shaped so that it conforms to the circular shape formed along the circumference of the encoder 335. In the simplest implementation, the encoder 335 includes a single reflective portion 485 and single non-reflective portion 480. As the encoder 335 rotates, the light source 410 illuminates the circumference of the encoder 335 and the light receiver 420 receives the light reflected by the reflective portions 485 for indicating the motion of the media 371.

Referring to FIG. 10, there is shown a fifth embodiment of the media motion encoder 336 of the present invention. The media motion encoder 336 includes the encoder 335 having one or more magnetic regions 465 each of a first magnetic strength (strong magnetic region) and one or more magnetic regions 470 each of a second strength (weak magnetic region). When there are a plurality of both magnetic regions 465 and 470, the regions 465 are in a spaced-apart relationship with each other and adjacent to a region 470 forming an alternating pattern. In the simplest implementation, the encoder 335 includes a single region 465 and single region 470. As the encoder 335 rotates, a magnetic field sensor 475 senses the magnetic strength of the magnetic regions 465 and 470 for indicating the motion of the media 371.

Referring to FIG. 11, there is shown a sixth embodiment of the media motion encoder 336. The media motion encoder 336 includes the encoder 335 having one or more magnetic north poles 490 placed along the circumference of the encoder 335 and one or more magnetic south poles 495 placed along the circumference of the encoder 335. When there are a plurality of both north poles 490 and south poles 495, the north poles 490 are in a spaced-apart relationship with each other adjacent to a south pole 495 in an alternating pattern. The poles 490 and 495 are arcuate shape to conform to the circular shape of the circumference portion of the encoder 335. In the simplest implementation, the encoder 335 includes a single pole 490 and single pole 495. As the encoder 335 rotates, a magnetic field sensor 475 senses the magnetic poles 490 and 495 for indicating the motion of the media 371.

It is instructive to emphasize that each embodiment of the encoder 335 is in direct contact with the media 371 so that greater accuracy is achieved in reading the motion of the media 371 and consequently the barcode data on the print media. Although numerous embodiments are shown for the media motion encoder and the encoder, the encoder disk of the present invention is not limited to these particular embodiments.

The invention has been described in detail with particular reference to certain preferred embodiments thereof, but it will be understood that variations and modifications can be effected within the spirit and scope of the invention.

PARTS LIST

10 Inkjet printer system
12 Image data source
14 Controller
15 Image processing unit
16 Electrical pulse source
18 First ink source
19 Second ink source
20 Recording medium
100 Inkjet printhead
110 Inkjet printhead die
111 Substrate
120 First nozzle array
121 Nozzle(s)
122 Ink delivery pathway (for first nozzle array)
130 Second nozzle array
131 Nozzle(s)
132 Ink delivery pathway (for second nozzle array)
181 Droplet(s) (ejected from first nozzle array)
182 Droplet(s) (ejected from second nozzle array)
200 Carriage
250 Print cartridge
251 Printhead die
253 Nozzle array
254 Nozzle array direction
255 Mounting substrate
256 Encapsulant
257 Flex circuit
258 Connector board
259 Lip
262 Ink sources
266 Device
267 Electrical contact
275 Rear Wall
300 Printer chassis
301 Drive system encoder
302 Paper load entry direction
303 Print region
304 Media advance direction
305 Carriage scan direction
306 Right side of printer chassis
307 Left side of printer chassis
308 Front of printer chassis
309 Rear of printer chassis
310 Hole (for paper advance motor drive gear)
311 Feed roller gear
312 Feed roller
313 Forward rotation direction (of feed roller)
320 Pick-up roller
322 Turn roller
323 Idler roller
324 Discharge roller
325 Star wheel(s)
330 Maintenance station
335 Encoder
336 Media motion encoder
340 Barcode sensor
345 Paper transport path
346 Paper tray
370 Stack of media
371 Top piece of medium
372 Barcode
373 Barcode lines
374 Non-print side of media
380 Carriage motor
382 Carriage guide rail
384 Belt
390 Printer electronics board
392 Cable connectors
400 Spokes
405 Open areas
410 Light source
420 Light receiver
445 Reflective portion
450 Non-reflective portions
460 Reflective surface
465 Strong magnetic field
470 Weak magnetic field
475 Magnetic field sensor
480 Non-reflective portion
485 Reflective portion
490 North pole
495 South pole
604 Signals
605 Elapsed time
606 Elapsed time
608 Signals
609 Signals
611 Signal counts
612 Signal counts

The invention claimed is:

1. An inkjet printer comprising:

(a) a paper tray for holding print media;

(b) a pick roller for moving the print media through a paper transport path;

(c) an encoder, which senses motion of the print media, disposed in the paper transport path, in direct contact with the print media as the print media passes through the paper transport path, and enables a signal to be provided which signal is indicative of the sensed motion; and (d) a barcode sensor for sensing a barcode on the print media; wherein the encoder provides improved accuracy of motion of the print media which enables improved accuracy of reading the barcode.

2. The inkjet printer as in claim 1, wherein the encoder includes one or more spokes and one or more open areas, wherein the spokes block passage of light and the open areas permit passage of light.

3. The inkjet printer as in claim 2 further comprising a light source that passes light toward the spokes of the encoder to a light receiver.

4. The inkjet printer as in claim 2 further comprising a light source and a receiver on a same side of the encoder and a reflective portion on an opposite side of the encoder, wherein the reflective portion reflects the light that passes through the spokes, which reflected light is received by the receiver.

5. The inkjet printer as in claim 1, wherein the encoder includes one or more reflective portions and one or more non-reflective portions that respectively reflects and does not reflect light.

6. The inkjet printer as in claim 5 further comprising a light source and a receiver on a same side of the encoder disk.

7. The inkjet printer as in claim 1, wherein the encoder includes one or more magnetic regions with alternating magnetization.

8. The inkjet printer as in claim 7 further comprising a magnetic field sensor in proximity to the magnetic regions, which magnetic field sensor senses the magnetization of the magnetic regions.

9. The inkjet printer as in claim 1, wherein the encoder includes one or more of magnetic regions with alternating polarities.

10. The inkjet printer as in claim 9 further comprising a magnetic field sensor in proximity to the magnetic regions, which magnetic field sensor senses the magnetization of the magnetic regions.

11. The inkjet printer as in claim 1, wherein the encoder includes a plurality of magnetic regions with alternating polarity disposed on a surface of the encoder.

12. The inkjet printer as in claim 11 further comprising a magnetic field sensor in proximity to the magnetic regions, which magnetic field sensor senses the magnetization of the magnetic regions.

13. The inkjet printer as in claim 1, wherein the encoder includes one or more reflective and non-reflective regions disposed on a surface of the encoder.

14. The inkjet printer as in claim 13 further comprising a light source and a receiver in proximity to the surface of the disk.

15. The inkjet printer as in claim 1 further comprising a drive system encoder.

16. The inkjet printer as in claim 1, wherein the encoder is a disk.

17. The inkjet printer as in claim 1, wherein the encoder is a drum.

* * * * *